US012311252B1

(12) United States Patent
Harrington

(10) Patent No.: US 12,311,252 B1
(45) Date of Patent: May 27, 2025

(54) BILLIARDS DEVICE AND METHOD

(71) Applicant: William Harrington, Oak Ridge, NC (US)

(72) Inventor: William Harrington, Oak Ridge, NC (US)

( * ) Notice: Subject to any disclaimer, the term of this patent is extended or adjusted under 35 U.S.C. 154(b) by 0 days.

(21) Appl. No.: 17/562,445

(22) Filed: Dec. 27, 2021

Related U.S. Application Data

(60) Provisional application No. 63/134,689, filed on Jan. 7, 2021.

(51) Int. Cl.
*A63D 15/00* (2006.01)

(52) U.S. Cl.
CPC ..... *A63D 15/005* (2013.01)

(58) Field of Classification Search
CPC ..... A63D 15/005
USPC ..... 473/40, 41
See application file for complete search history.

(56) References Cited

U.S. PATENT DOCUMENTS 743,464 A * 11/1903 D'Abramo ..... A63D 15/005 473/40
1,089,140 A * 3/1914 Madigan ..... A63D 15/005 473/40
2,405,677 A * 8/1946 Volpe ..... A63D 15/005 473/40
3,253,826 A * 5/1966 Cook ..... A63D 15/005 473/40
4,903,965 A * 2/1990 Smith ..... A63D 15/005 473/40
5,556,341 A * 9/1996 Bonn, Jr. ..... A63D 15/005 473/40
5,601,496 A * 2/1997 Beauchamp ..... A63D 15/005 473/40
7,166,033 B2 * 1/2007 Krajeski ..... A63D 15/005 473/40
7,785,209 B1 * 8/2010 Targosz, Jr. ..... A63D 15/005 473/21
8,911,299 B1 * 12/2014 Day ..... A63D 15/005 473/40
2005/0009614 A1 * 1/2005 Knight ..... A63D 15/005 473/40

* cited by examiner

*Primary Examiner* — Mitra Aryanpour
(74) *Attorney, Agent, or Firm* — MacCord Mason PLLC

(57) ABSTRACT

A universal receiver device and system. In one embodiment, a perimeter of a device includes a pair of fixed members and one pivotable member that is pivotable between an upward and downward direction. The device includes an inner billiard ball receiving cavity that may retain fifteen billiard balls. The result is a hybrid triangle for easily, and consistently, tightly racking billiard balls.

1 Claim, 5 Drawing Sheets

BILLIARDS DEVICE AND METHOD

This application claims the benefit of U.S. provisional application No. 63/134,689, filed Jan. 7, 2021, which is incorporated herein by reference in its entirety.

BACKGROUND

Field

The present disclosure relates generally to billiards and, more particularly, to a universal billiards rack receiver for enhancing the organizational alignment of billiard ball setup.

BRIEF DESCRIPTION OF THE DRAWINGS

Embodiments of the disclosure will be better understood by a reading of the Description of Embodiments along with a review of the drawings, in which.

SUMMARY

Figure 1:
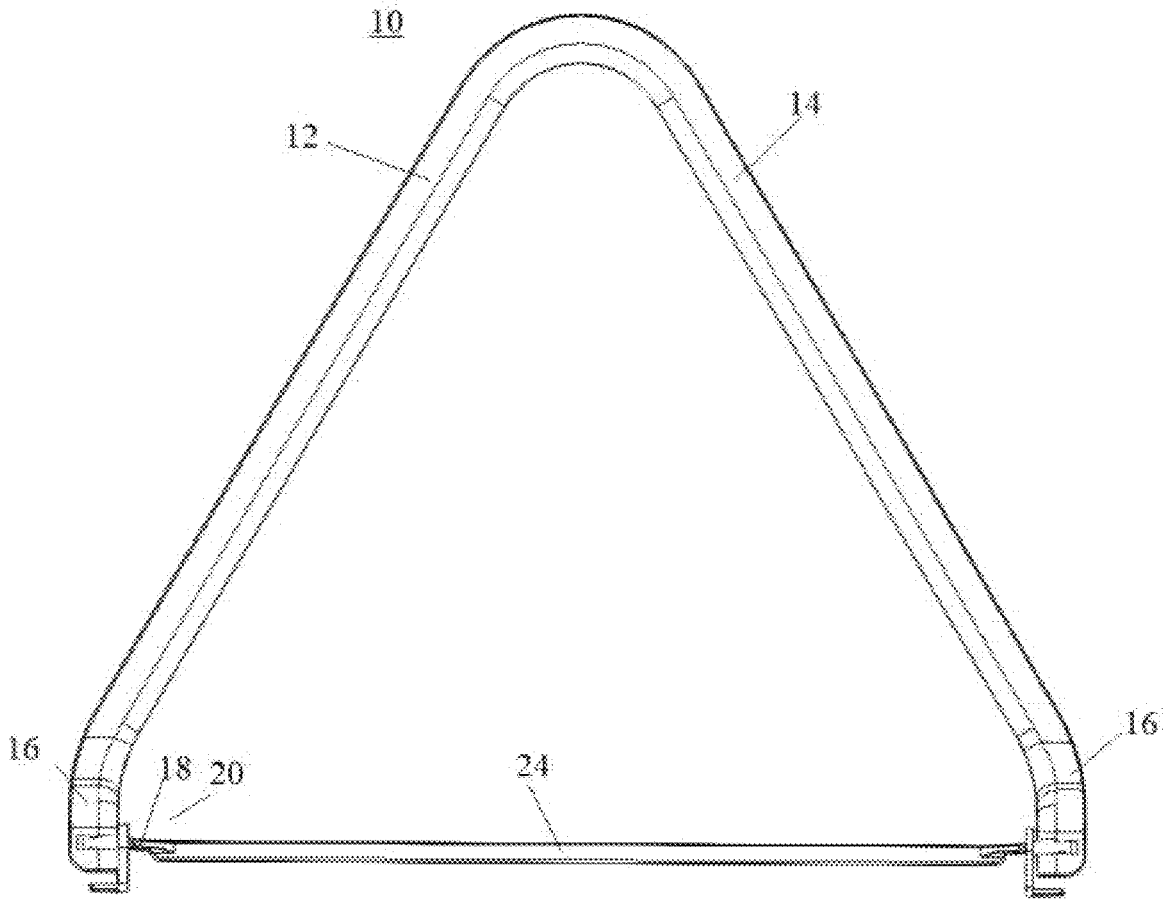
FIG. 1 is a top perspective view of a universal receiver in an operating position according to one embodiment of the disclosure.
Figure 2:
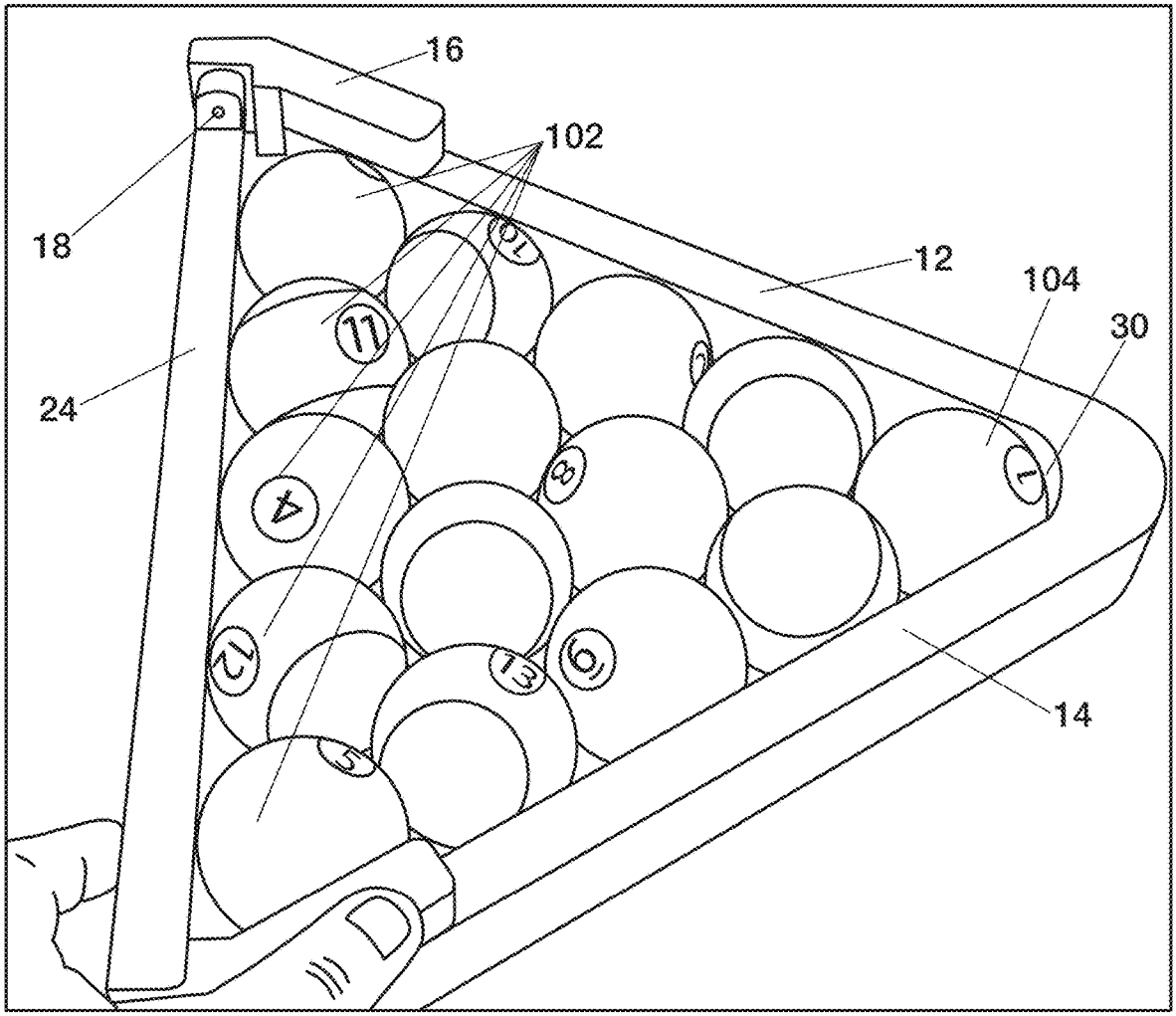
FIG. 2 is a top perspective view of a universal receiver in an operating position according to one embodiment of the disclosure.
Figure 3:
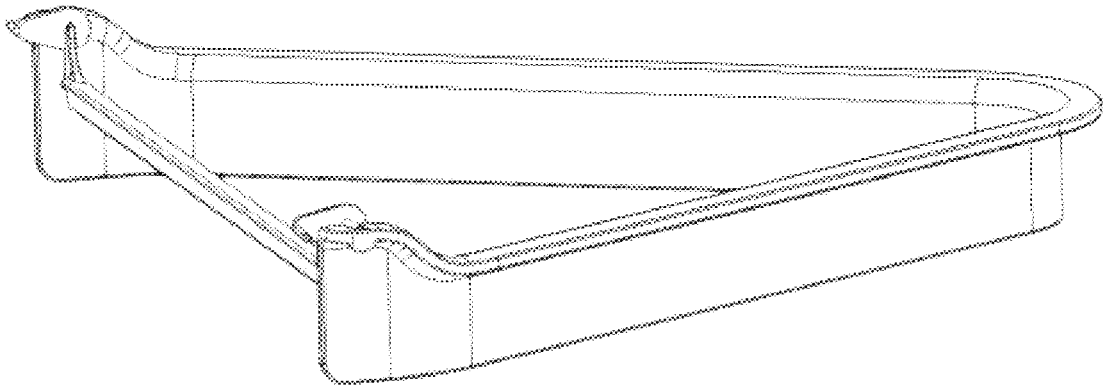
FIG. 3 is a top perspective view of a universal receiver in an operating position according to one embodiment of the disclosure.
Figure 4:
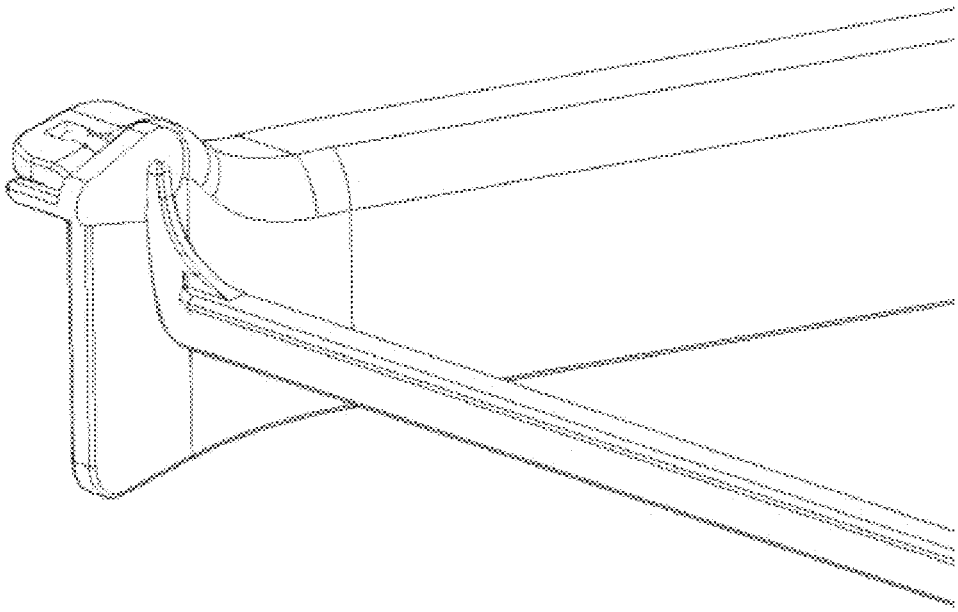
FIG. 4 is an isolated side perspective view of the universal receiver embodiment of FIG. 1, with elements removed for clarity.
Figure 5:
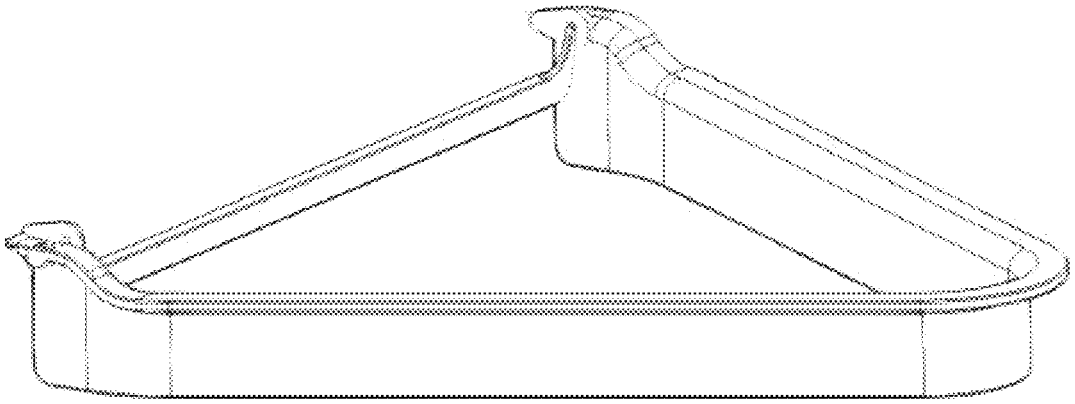
FIG. 5 is an isolated side perspective view of the universal receiver embodiment of FIG. 1.

Applicant desires a billiards device, system, and method without the drawbacks presented by the traditional systems and methods. For instance, conventional devices include fixed shape and size billiard ball racks that are not capable of being varied to accommodate specific assistance to align inner balls for proper placement. Those skilled in the art having the benefit of this disclosure will recognize additional features, advantages over conventional systems, and improvements for the enjoyment of billiards.

In accordance with the present inventions, a universal triangle receiver is provided for receiving and supporting a plurality of billiard ball combinations. These inventions provide an improved hybrid device and system that is convenient, efficient, and safe for the user, particularly when used in consistently tightly racking billiard balls on a playing surface.

In one embodiment, an apparatus comprises a first leading edge having an equilateral side length and a distal end; a second leading edge having an equilateral side length and a distal end; and a pivot assembly aligned between the opposing distal ends and having hinged gate handle, and wherein the hinged gate handle opposing an apice about the first leading edge and the second leading edge, and wherein the pivot assembly movable from a first position parallel with the first and second edges to a second substantially perpendicular position.

In certain examples, the first leading edge mechanically engages an offset. The offset positioned may be offset the first leading edge. The offset may align with an upper face of the first leading edge. The second leading edge may mechanically engage an offset. The offset may be positioned offset the second leading edge. The offset may align with an upper face of the second leading edge. The hinged gate handle may have a mating face.

In one embodiment, a triangle for racking billiard balls comprises a perimeter having a pair of fixed members and one pivotable member aligned between opposing distal ends of the fixed members and pivotable between an upward and downward direction; and an inner billiard ball receiving cavity having a size adapted to retain fifteen billiard balls.

In certain examples, a space may provide a sufficient clearance during pivot movement of the pivotable member. The pivotable member may include a hinged gate handle. The hinged gate handle may oppose an apice about the fixed members. The hinged gate handle may include at least one hinge. The pivotable member may have a mating face and adapted for rotational movement about hinges. The pivotable member may be movable from a first position parallel with the fixed members to a second substantially perpendicular position, and wherein the second position comprising an overlying position substantially parallel to the fixed members.

In one embodiment, a system for racking billiard balls comprises a first and second leading edge, each edge having adjacent proximate edges and opposing distal ends, and wherein the proximate ends of the first and second leading edges secured about one another; a first offset adjacent the distal end of the first leading edge, and wherein the first leading edge mechanically engages the first offset; a second offset adjacent the distal end of the second leading edge, and wherein the second leading edge mechanically engages the second offset; and a movable hinged gate hinged between the first offset and the second offset, and opposing an apice about the first leading edge and the second leading edge, and wherein the movable hinged gate adapted to rotate between a first position to a substantially perpendicular second position.

In one example, the first offset aligns with an upper face of the first leading edge; and the second offset aligns with an upper face of the second leading edge. The hinged gate may include a mating face with a substantially flat surface configured to interface with a plurality of billiard balls. The hinged gate may provide rotational movement about hinges. The hinged gate may be movable from a first position parallel with the first and second edges to a second substantially perpendicular position.

In one embodiment, a system for racking billiard balls comprises a first and second leading edge, each edge having adjacent proximate edges and opposing distal ends; a first offset flange offset above the distal end of the first leading edge; a second offset flange offset above the distal end of the second leading edge; and a movable hinged gate hinged between the first offset flange and the second offset flange, and wherein the movable hinged gate adapted to rotate between a first position to a substantially perpendicular second position.

In particular examples, the first leading edge has an equilateral side length. The second leading edge may include an equilateral side length. The hinged gate may oppose an apice about the first leading edge and the second leading edge. The hinged gate may include at least one hinge. The system may include at least one fastener pin. The first leading edge may mechanically engages the first offset flange. The first offset flange may align with an upper face of the first leading edge. The second leading edge may mechanically engages the second offset flange. The second offset flange may align with an upper face of the second leading edge.

In certain examples, the hinged gate may include a mating face. The mating face may include a substantially flat surface configured to interface with a plurality of billiard balls. The substantially flat surface may interface with a row of five billiard balls. The system may include a plurality of the billiard balls come into contact with the leading edges. The billiard balls may move to a touching relationship with one another. The billiard balls may conform to a shape of a triangular alignment with all billiard balls in a touching relationship with one another.

In particular examples, the hinged gate may rotationally move about at least one hinge, including two hinges. The hinged gate may be movable from a first position parallel with the first and second edges to a second substantially perpendicular position. The second position may include an overlying position substantially parallel to the billiard balls. The second position may include an overlying position substantially parallel to the first and second leading edges. The hinged gate may be rotatable about hinges to substantially ninety degrees with respect to the billiard balls. The hinged gate may be rotatable about hinges to substantially one hundred and eighty degrees with respect to a surface.

In certain examples, the system may include a substantially rigid material. The deice may generally route a plurality of billiard balls into a traditional, tightly racked alignment position. Further, the proximate ends of the first and second leading edges may be secured together.

In one embodiment, an apparatus for use in racking billiard balls comprises a first leading edge having an equilateral side length and a distal end; a second leading edge having an equilateral side length and a distal end; and a pivot assembly aligned between the opposing distal ends.

In particular examples, the pivot assembly may include a hinged gate handle. The hinged gate handle may oppose an apice about the first leading edge and the second leading edge. The hinged gate handle may include at least one hinge. The apparatus may include at least one fastener pin.

In certain examples, the first leading edge mechanically engages an offset flange support. The offset flange support may be positioned offset the first leading edge. The offset flange may align with an upper face of the first leading edge. The second leading edge may mechanically engage an offset flange support. The offset flange support may be positioned offset the second leading edge. The offset flange may align with an upper face of the second leading edge.

In particular examples, the hinged gate handle may include a mating face. The mating face may include a substantially flat surface configured to interface with a plurality of billiard balls. The substantially flat surface may interface with a row of five billiard balls. The plurality of billiard balls may come into contact with the leading edges. The billiard balls may move to a touching relationship with one another. The billiard balls may conform to a shape of a triangular alignment with all billiard balls in a touching relationship with one another.

In certain examples, the pivot assembly is adapted for rotational movement about hinges. The pivot assembly may be movable from a first position parallel with the first and second edges to a second substantially perpendicular position. The second position may include an overlying position substantially parallel to the billiard balls. The second position may include an overlying position substantially parallel to the first and second leading edges.

The pivot assembly may be rotatable about hinges to substantially ninety degrees with respect to the billiard balls. The pivot assembly may be rotatable about hinges to substantially one hundred and eighty degrees with respect to a surface.

In particular examples, the apparatus may include a substantially rigid material. The apparatus may be adapted to route a plurality of billiard balls into an alignment position. The first and second leading edges may include adjacent proximate ends that are generally secured together.

In one embodiment, a triangle for racking billiard balls comprises a perimeter having a pair of fixed members and one pivotable member pivotable between an upward and downward direction; and an inner billiard ball receiving cavity adapted to retain fifteen billiard balls.

In certain examples, the device may include a space between the pivotable member and the inner cavity adapted to support a row of five billiard balls. The space may provide a sufficient clearance during pivot movement of the pivotable member. The pivotable member may be aligned between opposing distal ends of the fixed members.

In particular examples, the pivotable member may include a hinged gate handle. The hinged gate handle may oppose an apice about the fixed members. The hinged gate handle may include at least one hinge. The device may include at least one fastener pin. The at least one fixed member may support an offset flange support. The offset flange support may be positioned offset the fixed member and adapted to space the pivotable member. The offset flange may align with an upper face of the fixed member.

In certain examples, the pivotable member may include a mating face. The mating face may include a substantially flat surface configured to interface with a plurality of billiard balls. The substantially flat surface may be configured to interface with a row of five billiard balls. The billiard balls may come into contact with the fixed members. The billiard balls may move to a touching relationship with one another. The billiard balls may conform to a shape of a triangular alignment with all billiard balls in a touching relationship with one another.

In particular examples, the pivotable member may be adapted for rotational movement about hinges. The pivotable member may be movable from a first position parallel with the fixed members to a second substantially perpendicular position. The second position may include an overlying position substantially parallel to the billiard balls. The second position may include an overlying position substantially parallel to the fixed members. The pivotable member may be rotatable about hinges to substantially ninety degrees with respect to the billiard balls.

In certain examples, the pivotable member may be rotatable about hinges to substantially one hundred and eighty degrees with respect to a surface. The device may include a substantially rigid material. The device may be adapted to tightly align a plurality of billiard balls into an alignment position. The fixed members may include adjacent proximate ends secured together. The triangle may be an integral one-piece structure.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

DETAILED DESCRIPTION

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing embodiments of the disclosure and are not intended to limit the disclosure or any inventions thereto. As best seen in FIGS. 1-5, the universal receiver racking apparatus 10 provides billiard ball alignment management. As shown in the figures, the device may include a first leading edge 12, an adjacent leading edge 14, and an opposing pivot assembly 24. Those skilled in the art having the benefit of this disclosure will recognize additional sizes, orientations, material, and arrangement of elements.

In one embodiment, an apparatus 10 for use in racking billiard balls 100 comprises a first leading edge 12 having an equilateral side length and a distal end; a second leading edge 14 having an equilateral side length and a distal end; and a pivot assembly 24 aligned between the opposing distal ends of the first leading edge 12 and the second leading edge 14.

The system for racking billiard balls 100 may include a first offset flange 16 that is generally offset above the distal end of the first leading edge 12 to provide any of the clearances, including but not limited to vertical spacing, for movement shown and described herein; a second offset flange 16 that is generally offset above the distal end of the second leading edge 14 to provide any of the clearances, including but not limited to vertical spacing, for movement shown and described herein; and a movable hinged gate 24 hinged 18 between the first offset flange 16 and the second offset flange 16. As shown in the various figures, the movable hinged gate 24 may rotate between a first position (FIG. 2) to a substantially perpendicular second position. Those skilled in the art having the benefit of this disclosure will recognize additional scaling, elemental orientation, and arrangements within the spirit of this disclosure.

In one embodiment, a triangle 10 for racking billiard balls comprises a perimeter 20 having a pair of fixed members 12,14 and one pivotable member 24 that is generally pivotable between an upward and downward direction, including any combination thereof. The triangle device 10 includes an inner billiard ball receiving cavity to retain fifteen billiard balls 100, however those skilled in the art having the benefit of this disclosure will recognize additional billiard ball set-ups.

In certain examples, the hinged gate 24 may include a mating face. The mating face may include a substantially flat surface configured to interface with a plurality of billiard balls 100. The substantially flat surface may interface with a rear row of five billiard balls 102, including Applicant has unexpectedly discovered the advantages of a tightly aligned resulting row result. The system may include a plurality of the billiard balls come into contact with the leading edges 12, 14, for instance an upper positioned billiard ball 104 about the apice of the fixed leading edges 12,14. As shown and described herein, the billiard balls may move to a touching relationship with one another, for instance use of the device may conform the arrangement of the billiard balls into a shape of a consistently tightly-racked triangular alignment, with all billiard balls in a touching relationship with one another.

In operation, as shown, the device 10 may include a space 40 between the pivotable member 24 and the inner cavity to support a row of five billiard balls 102. The space 40 may provide a sufficient clearance during any of the pivot movement of the pivotable member 24 shown and described herein.

In other embodiments, the disclosure includes a billiard kit. In such an embodiment, the kit may comprise a receiver 10, e.g. any of the triangle receiver elements and components previously shown or described. Further, other embodiments of the kit may comprise billiard balls 100, e.g. any combination of billiard balls and the like elements and components previously shown or described.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

What is claimed is:

1. A system for racking billiard balls on a surface, said system consisting of:

a first and second leading edge, each edge having adjacent proximate edges and opposing distal ends, and wherein said proximate ends of said first and second leading edges secured about one another;

a first offset being adjacent and vertically spaced from said distal end of said first leading edge, and wherein said first leading edge mechanically supports said first vertical offset and wherein said first offset aligns with an upper face of said first leading edge;

a second offset being adjacent and vertically spaced from said distal end of said second leading edge, and wherein said second leading edge mechanically supports said second vertical offset and wherein said second offset aligns with an upper face of said second leading edge; and a rotational movement hinged gate hinged between said first vertical offset and said second vertical offset and having a mating face with a substantially flat surface configured to interface with a plurality of billiard balls, and opposing an apice about said first leading edge and said second leading edge, and wherein said movable hinged gate having a fastener pin and rotates about a hinge ninety degrees with respect to said billiard balls and one hundred and eighty degrees with respect to said surface between a first substantially horizontal position to a substantially perpendicular second position, and wherein said hinged gate traverses from a first position parallel with said first and second edges to a second perpendicular position consisting of an overlying position parallel to said billiard balls and parallel to said first and second leading edges.

* * * * *